United States Patent [19]

Sigott et al.

[11] 4,404,893

[45] Sep. 20, 1983

[54] HYDRAULIC MINE PROP

[75] Inventors: Siegfried Sigott; Heinrich Suessenbeck; Alfred Zitz, all of Zeltweg; Gottfried Siebenhofer, Vienna, all of Austria

[73] Assignee: Vereinigte Österreichische Eisen- und Stahlwerke - Alpine Montan Aktiengesellschaft, Vienna, Austria

[21] Appl. No.: 887,774

[22] Filed: Mar. 17, 1978

Related U.S. Application Data

[63] Continuation of Ser. No. 719,652, Sep. 1, 1976.

[30] Foreign Application Priority Data

Sep. 9, 1975 [AT] Austria ..... 6947/75

[51] Int. Cl.[3] ..... F15B 15/22

[52] U.S. Cl. ..... 91/405; 91/409; 92/110; 248/354 H

[58] Field of Search ..... 91/408, 409, 405, 468; 92/110, 163; 248/354 H

[56] References Cited

U.S. PATENT DOCUMENTS

| | | | |
|---|---|---|---|
| 2,139,185 | 12/1938 | Engel | 91/468 |
| 3,138,066 | 6/1964 | Walker | 91/408 X |
| 3,147,671 | 9/1964 | Geyer | 92/109 X |
| 3,249,018 | 5/1966 | Ellis, Jr. | 91/468 X |
| 3,559,538 | 2/1971 | Holder | 91/409 |

FOREIGN PATENT DOCUMENTS

| | | | |
|---|---|---|---|
| 39549 | 3/1957 | Poland | 248/354 H |
| 92916 | 2/1922 | Switzerland | 248/354 H |
| 290688 | 5/1928 | United Kingdom | 91/468 |
| 843354 | 8/1960 | United Kingdom | 248/354 H |
| 844137 | 8/1960 | United Kingdom | 248/354 H |

*Primary Examiner*—Martin P. Schwadron
*Assistant Examiner*—Richard L. Klein
*Attorney, Agent, or Firm*—Cushman, Darby & Cushman

[57] ABSTRACT

A hydraulic mine prop includes an inner piston-like prop guided within an outer cylinder-like prop, and a roof fall valve. The interior space of said inner prop communicates freely with the working chamber of the prop, and the roof fall valve is arranged outwardly on the prop and rigidly secured thereon, the valve being connected to the working chamber by an orifice provided in the prop and leading to the working chamber. The cross-sectional area of the roof fall valve in its open position.

1 Claim, 2 Drawing Figures

HYDRAULIC MINE PROP

This is a continuation of application Ser. No. 719,652 filed Sept. 1, 1976.

The present invention relates to a hydraulic mine prop comprising an inner prop guided within an outer prop, said inner prop operating as a piston working in the outer prop as in a cylinder, and further comprising a roof fall valve. A fall of roof effects in overloading the mine prop or the roof supporting frame comprising the props. If the overloading is not immediately given way, in most of cases breakage of the props or of the frame is the consequence. It has been proposed, therefore, to provide roof fall valves having a great cross-section area in its outlet to enable the prop to rapidly lower under an arising roof pressure.

Such roof fall valves integrated in the bottom of the prop are well known. The prop is supported by heavy Belleville spring washers which undergo deformation when a fall of roof occurs. The spring deformation simultaneously serves to open the roof fall valve. By using such valves hard impacts affecting the prop are eliminated. On the other hand, it is a disadvantage that such heavy spring washers are needed and that the valve which is placed on the bottom of the prop is not accessible without completely dismounting the prop. Further it is known to place the roof fall valve in the interior of the prop, but also with this construction the bad accessibility remains a disadvantage. And in comparison with said heavy spring washers, there arises the further drawback that a fall of roof causes a hard impact on the prop. Further it is known to provide the roof fall valve outside of the prop connecting it to the working chamber of the prop by means of a flexible tube, in that case, the passage area limited by the cross-section of the tube is a drawback since the discharge is dangerously retarded. A fall of roof may generate a pressure of 700 to 1000 bar, and with such values of pressure it is generally impossible to make use of a flexible tube.

It is the scope of the present invention to eliminate the aforementioned disadvantages. The invention resides essentially in that the interior space of said inner prop communicates freely with the working chamber of the prop, that said roof fall valve is arranged outwardly on the prop and rigidly secured thereon, and that the valve is connected to said working chamber by an orifice provided in the prop and leading to the working chamber, the cross-sectional area of said orifice equalling at least the passage area of said roof fall valve in its open position. The interior space of the inner prop increases the capacity of the working chamber. Thus with high pressure values an elasticity of the support is achieved since with high pressure values also the fluid which is composed mostly of water and oil turns out to be to a small degree resilient. With such an increased capacity of the volume receiving the pressure fluid the elasticity is sufficient to avoid a hard impact on the prop as a result of high pressure values. That is achieved without using said heavy Belleville spring washers. The roof fall valve mounted outside of the prop is easily accessible for inspection, and since it is secured on the prop without connecting tubes, it is possible to provide a great cross-sectional area for the passage from the working chamber in the prop to the roof fall valve; said area equals at least the outlet passage of the valve in its opened position.

Preferably the inner prop is shaped as a tube which is open towards the working chamber.

In a preferred embodiment the orifice leading to the working chamber of the prop is positioned on the outer prop at the circumference thereof and at its end opposed to the inner prop or, respectively, at or near the lower end of the outer prop. With the usual structure where the outer prop is positioned below and the inner prop is positioned above, the said end of the outer prop is its lower end. This arrangement has several advantages. The valve is positioned at a location where it is less inconvenient whereas a location e.g. on the inner prop would shorten the telescoping way of said prop.

According to the invention, the roof fall valve has outlet openings for the pressure medium, said openings preferably discharging into the atmosphere and being downwards directed. Also in this regard the location of the valve on the lower end of the outer prop is advantageous since a jet of pressure fluid does not disturb on this place.

A further advantage resides in that another preferred feature of the invention is made possible, that feature being characterized in that the end of the inner prop directed towards the working chamber slides when fully lowered over the orifice leading to said working chamber. This throttles the outflow of the pressure fluid from the working chamber as soon as the prop is almost completely lowered. If the outlet orifice is foreseen not much distant from the bottom of the outer prop, the outflow is even nearly interrupted. In this way, a fluid cushion is formed within the working chamber of the prop inhibiting the inner prop from impacting hardly on the bottom of the outer prop.

A further advantageous proposal of the invention consists in that the end of the inner prop directed towards the working chamber has on its outer surface at least one sealing ring which is located so as not to obstruct the orifice leading to the working chamber even in the completely contracted position of the prop. Thereby the outflow of the fluid from the working is retarded nearly before the contracting movement has ended, the retardation being effected to such an extent that impacting of the inner prop against the limit stop is avoided although the whole telescope way is exploitable.

Since the orifice interconnecting the working chamber with the valve is foreseen on the circumference of the outer prop, the bottom of the outer prop which mostly has a spherical form remains free.

But now, the lowest portion of the supporting frame is generally not accessible owing to the covering boards. In this case, it may be useful that said orifice leading from one side to the working chamber leads from its other side to a pocket which is secured, in particular by welding, onto the outer prop, whilst the roof fall valve is mounted on the upper end of said pocket. Additionally, it may be provided that the conduit supplying the pressure medium for operating the mine prop is connected to said pocket.

The invention is further illustrated with respect to the accompanying drawing which shows an embodiment of the invention.

Figure 1:
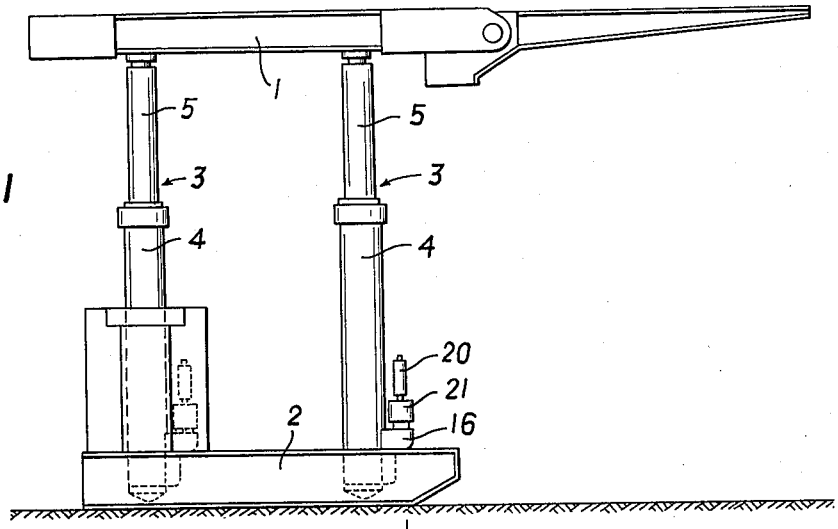
FIG. 1 shows a mine roof supporting frame having props.

The roof supporting frame shown in FIG. 1 has a cap 1 supported against the floor frame 2 by means of four props 3 each of them consisting of an outer prop 4 and an inner prop 5 telescopically shiftable within said outer prop. At the lower end of the outer props the roof fall valves are arranged as to be seen from FIG. 2.

Figure 2:
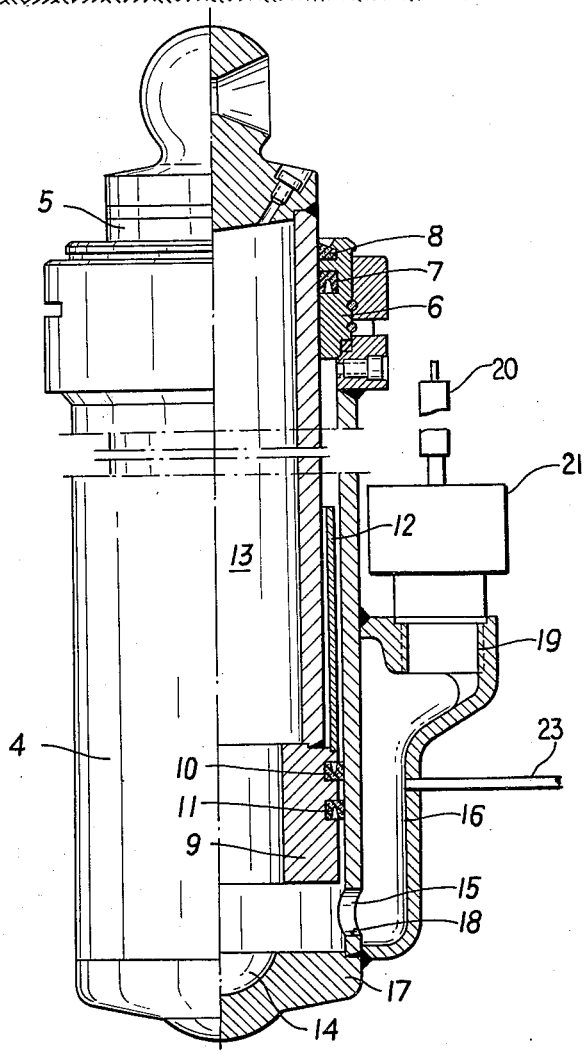
FIG. 2 is a side elevation and partly a cross-sectional view of a prop.

The inner prop 5 is guided telescopically in the outer prop 4 (see FIG. 2). A ring 6 is mounted on the upper end of the outer prop 4, and two sealing rings 7,8 fitting tightly against the inner prop 5 are inserted into the ring 6. The inner prop 5 is shaped like a tube. A ring 9 is welded onto the lower end of said prop 5. Sealing rings 10, 11 fitting tightly against the internal face of the outer prop are inserted into the ring 9. A tube section 12 is provided to prevent the inner prop from being drawn out too largely.

The tube-like inner prop 5 is open at its lower end so that its interior space 13 communicates freely with the working chamber 14 of the prop. By that way, the volume of the pressure medium contained in the prop is considerably increased, and with regard to this great volume a certain elasticity is achieved as a consequence of the compressibility of the pressure medium.

An orifice 15 having a great cross-sectional area of passage is provided at the lower end of the tube-shaped wall of the outer prop 4. This opening connects the working chamber 14 to a pocket 16 welded onto the outer prop 4. The lower end of the ring 9 slides in its lowest position over the orifice 15. As soon as this occurs the passage through the orifice 15 is throttled. So the inner prop is caught softly at its lowest position avoiding an impact on the bottom 17 of the outer prop 4. Since the sealing ring 11 even in its lowest position remains above the orifice 15, said opening is not tightly closed when the inner prop is fully lowered. Nevertheless, as soon as the ring 9 is sliding over the lower edge 18 of the orifice 15, the throttling effect is strong enough that in practice one can talk of a closure. The prop is softly kept up by the volume of the pressure medium contained within the prop.

An internal thread 19 is foreseen at the upper end of the pocket 16 to screw therein the male thread of the roof fall valve 21. By means of the pocket 16 said valve is situated high enough to be accessible although the bottom 17 of the outer prop 4 is positioned below the upper edges of the floor frame 2. The housing which contains the valve spring is indicated by 20. A conduit 23 connected to the pocket 16 supplies the pressure medium for operating the prop.

What we claim is:

1. A hydraulic mine prop comprising an inner tubular prop for supporting a mine roof guided within an outer tubular prop, said inner prop having an open end disposed within the outer prop and facing toward a closed end of the outer prop, said inner prop operating as a piston working in the outer prop as in a cylinder, the interior space of said inner prop communicating freely with a fluid pressure working chamber in said outer prop, said outer prop having an orifice at the circumference thereof at said closed end, said orifice being open on one side to the working chamber and being open on its other side to a pocket which is rigidly secured onto the outer surface of said outer prop, a threaded bore in the outer surface of the upper end of said pocket, an externally-mounted pressure-responsive roof fall valve secured in said threaded bore in the upper end of said pocket in a position generally parallel to said outer prop, said roof fall valve having an outlet passage which discharges pressure medium from said working chamber when the valve is in its opened position thereby enabling the inner prop to move into the outer prop under an increasing roof pressure, the cross-sectional area of said orifice equalling at least the passage area of said roof fall valve in its open position, and the end of the inner prop directed towards the working chamber being slidable when fully lowered over the orifice to thereby throttle the latter, said end having at least one sealing ring provided thereon at such an axial location as not to obstruct said orifice when said inner prop is moved into said outer prop the maximum distance, and means for connecting said mine prop to a source of fluid pressure.

* * * * *